US005900847A

United States Patent [19]

Ishikawa et al.

[11] Patent Number: 5,900,847

[45] Date of Patent: May 4, 1999

[54] DIELECTRIC LENS APPARATUS

[75] Inventors: Yohei Ishikawa, Kyoto; Hideaki Yamada, Nagaokakyo; Kazutaka Higashi, Hirakata; Yasuaki Saitoh, Kyoto, all of Japan

[73] Assignee: Murata Manufacturing Co., Ltd., Japan

[21] Appl. No.: 08/784,946

[22] Filed: Jan. 16, 1997

[30] Foreign Application Priority Data

Jan. 18, 1996 [JP] Japan ..... 8-6208

[51] Int. Cl.[6] ..... H01Q 1/38

[52] U.S. Cl. ..... 343/909; 343/756

[58] Field of Search ..... 343/909, 702, 343/756, 700 MS, 911 R; H01Q 1/38

[56] References Cited

U.S. PATENT DOCUMENTS

| | | | |
|---|---|---|---|
| 4,755,820 | 7/1988 | Backhouse et al. | 343/700 |
| 5,185,613 | 2/1993 | Whatmore et al. | 343/909 |
| 5,455,594 | 10/1995 | Blasing et al. | 343/909 |

FOREIGN PATENT DOCUMENTS

| | | |
|---|---|---|
| 0420137 | 4/1991 | European Pat. Off. . |
| 0632524 | 1/1995 | European Pat. Off. . |
| 2029114 | 3/1980 | United Kingdom . |
| 8908932 | 9/1989 | WIPO . |

OTHER PUBLICATIONS

NTIS Tech Notes , Jan. 1 1991, p. 17/1,2 XP000383480 "Advertisement" European Search Report dated Apr. 18, 1997.

*Primary Examiner*—Hoanganh Le
*Assistant Examiner*—Kimnhung Nguyen
*Attorney, Agent, or Firm*—Ostrolenk,Faber,Gerb & Soffen,LLP

[57] ABSTRACT

The radiation directivity of radio waves can be controlled more easily over a wider range by using the disclosed dielectric lens. A dielectric lens element having a curved surface is bonded to one of the surfaces of a laminate element in the shape of a flat plate in which a plurality of dielectric layers whose relative dielectric constants are different for adjacent layers are laminated. By controlling the distribution mode of the relative dielectric constants in the laminate element, the radiation directivity for the entire dielectric lens apparatus can be controlled; therefore, the radiation directivity can be controlled more easily over a wider range. A focal point may be positioned within or at the surface of the laminate element, and a signal processing circuit may be formed within and/or at the surface of the laminate element.

26 Claims, 1 Drawing Sheet

DIELECTRIC LENS APPARATUS

BACKGROUND OF THE INVENTION

1. Field of the Invention

The present invention relates to a dielectric lens apparatus employing a solid dielectric. More particularly, the present invention relates to a dielectric lens apparatus for use in a high frequency band.

2. Description of the Related Art

FIG. 3 shows a conventional typical dielectric lens 1.

A dielectric lens 1 has a curved surface 2 which is formed into, for example, a convex surface. Such a dielectric lens 1 functions to refract radio waves 3 which enter from the curved surface 2 side so they converge at a focal point 4.

However, a dielectric lens 1 such as that shown in FIG. 3 has the following problems.

First, the radiation directivity of the radio waves 3 is determined substantially by the shape of the dielectric lens 1 and the dielectric constant of the dielectric which forms the dielectric lens 1. For this reason, the dielectric lens 1 arranged as shown in FIG. 3 has only a small degree of freedom concerning radiation directivity, and so it is relatively difficult to control radiation directivity.

Also, since the focal point 4 is positioned outside the dielectric lens 1, if an obstacle is present between the dielectric lens 1 and the focal point 4, as a matter of course, the radio waves 3 will be shielded, causing the dielectric lens 1 not to function as a lens.

SUMMARY OF THE INVENTION

Accordingly, the present invention advantageously provides a dielectric lens apparatus which is capable of solving problems such as those described above.

To achieve the above-described object, according to the present invention there is provided a dielectric lens apparatus, comprising: a laminate element in which a plurality of dielectric layers are laminated, wherein relative dielectric constants are made different for adjacent layers; and a dielectric lens element which has a curved surface and which is bonded to one of the surfaces of the laminate element with the curved surface facing outwards.

In the present invention, preferably, the focal point of the dielectric lens apparatus is positioned within or at the surface of the laminate element.

Further, in the present invention, at least a part of a signal processing circuit may be formed within and/or on the surface of the laminate element.

According to the present invention, in addition to a dielectric lens element having a curved surface, a laminate element is provided with a plurality of dielectric layers whose relative dielectric constants are different for adjacent layers. Therefore, it becomes possible to control radiation directivity by not only controlling the shape of the dielectric lens element and the dielectric constant of a dielectric which constitutes the dielectric lens element, but also by controlling the distribution of the relative dielectric constants of each dielectric layer in the dielectric element. Therefore, it is possible to widen the range of control of radiation directivity. As a result, it is possible to widen the applicable range of the dielectric lens apparatus and provide convenience in designing dielectric lens apparatus.

When a laminate element is provided, the focal point of the dielectric lens apparatus can easily be positioned within or at the surface of the laminate element. When the focal point of the dielectric lens apparatus can be positioned within or at the surface of the laminate element in such a manner as described above, there is no room for an obstacle to enter the space between the focal point and the dielectric lens element, thereby making it possible to prevent radio waves from being shielded by such an obstacle.

In the present invention, as described above, at least a part of a signal processing circuit can be formed within and/or on the surface of the laminate element. If at least a part of a signal processing circuit is formed within a laminate element in the manner as described above, a dielectric lens apparatus having the circuit integrated therein can be obtained, making it possible to achieve a multi-function dielectric lens apparatus. This contributes to a smaller size and higher performance electronic apparatus employing such dielectric lens apparatus.

The above and further objects, aspects and novel features of the invention will more fully appear from the following detailed description when read in connection with the accompanying drawings.

DESCRIPTION OF EMBODIMENTS OF THE INVENTION

Figure 1:
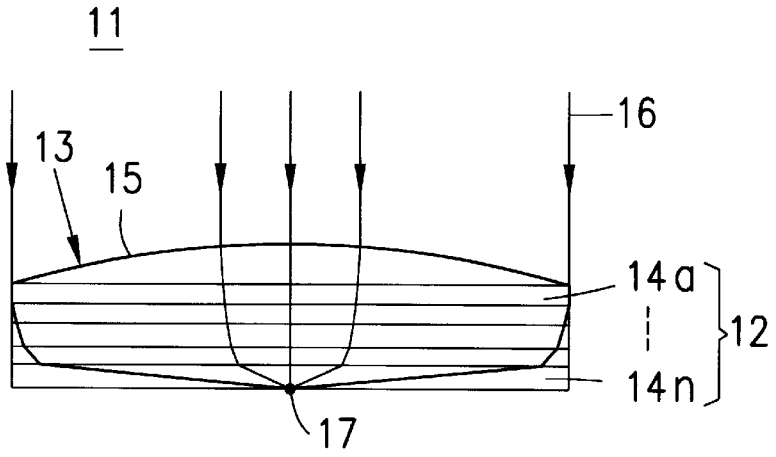
FIG. 1 is a sectional view illustrating a dielectric lens apparatus according to an embodiment of the present invention.

FIG. 1 is a sectional view illustrating a dielectric lens apparatus 11 according to an embodiment of the present invention. The dielectric lens apparatus 11 comprises a laminate element 12 and a dielectric lens element 13.

The laminate element 12 has a flat plate shape in which a plurality of dielectric layers 14*a*, . . . , 14*n* are laminated. The relative dielectric constants of these dielectric layers 14*a*, . . . , 14*n* are different for adjacent dielectric layers. In this embodiment, the relative dielectric constants are changed incrementally in such a manner as to have a stepped gradient from the topmost dielectric layer 14*a* to the bottommost dielectric layer 14*n*.

Concerning each of the dielectric layers 14*a*, . . . , 14*n*, or one dielectric layer 14*a* for instance, each layer may be formed of a plurality of layers having the same relative dielectric constant in the manufacturing process therefor. Further, each of the dielectric layers 14*a*, . . . , 14*n* may not have the same thickness. In the embodiment shown in the figure, not only does the laminate element 12 have a flat plate shape, but also each of the dielectric layers 14*a*, . . . , 14*n* which constitute the laminate element 12 has a flat plate shape. However, each of these dielectric layers may be formed into any desired shape, for example, a shape such that they are in contact with each other via a conical-shaped or cone-shaped interface according to the desired state of refracted radio waves.

On the other hand, the dielectric lens element 13 has a curved surface 15 which provides a convex surface. This dielectric lens element 13 is bonded to one of the surfaces of the laminate element 12 with the curved surface 15 facing outwards. Although in this embodiment the curved surface 15 of the dielectric lens element 13 provides a convex surface, the shape of this curved surface may be any other shape, for example, a shape which provides a concave surface or which provides a convex surface in the central portion and a concave surface in the surrounding portion.

This dielectric lens apparatus 11 functions to refract radio waves 16 which enter from the curved surface 15 side so they converge at a focal point 17. In this embodiment, a design is used such that the focal point 17 is positioned at the surface of the laminate element 12.

In such a dielectric lens apparatus 11, by changing the distribution mode of the relative dielectric constants in the laminate element 12, it is possible to control the radiation directivity of the radio waves 16, and it is relatively easy to obtain desired radiation directivity. This distribution mode of the relative dielectric constants can be selected as desired according to the radiation directivity to be obtained. More specifically, in this embodiment as described above, the relative dielectric constants are provided to have a gradient in such a way that the relative dielectric constants decrease in a stepped manner from the topmost dielectric layer 14*a* to the bottommost dielectric layer 14*n*; however, an inverse gradient may be provided, or rather than having relative dielectric constants varying only in one direction, the distribution mode of the relative dielectric constants can be provided such that they first increase and then decrease in the thickness direction of the laminate element 12.

In this embodiment, since the focal point 17 is positioned at the surface of the laminate element 12, there is no room for an obstacle to enter the space between the focal point 17 and the dielectric lens element 13, thereby making it possible to prevent radio waves from being shielded by such an obstacle.

Also, when such a focal point is positioned within the laminate element 12, similar advantages can be obtained.

The dielectric lens apparatus 11 can be manufactured by applying a manufacturing method which is basically similar to that used for, for example, laminate ceramic electronic parts. More specifically, dielectric ceramic green sheets capable of providing desired relative dielectric constants for each of the plurality of dielectric layers 14*a*, . . . , 14*n* which constitute the laminate element 12 and dielectric ceramic green sheets for the dielectric lens element 13 are prepared, and these ceramic green sheets are laminated and pressed. This pressing causes the contact characteristic of the plurality of ceramic green sheets to increase and molds the curved surface 15 of the dielectric lens element 13. Thereafter, by baking the ceramic green sheets, the dielectric lens apparatus 11 can be obtained.

If the curved surface 15 of the dielectric lens element 13 is not properly molded in the above-described pressing process, polishing or cutting may be performed after baking to form the curved surface 15.

In order to provide each of the plurality of dielectric layers 14*a*, . . . , 14*n* which constitute the laminate element 12 and the dielectric lens element 13 with a desired relative dielectric constant, a method of mixing resins with dielectric ceramic powder may be used. In such a case, a sheet in which a heat-curing resin, such as polypropylene, polyethylene or polystyrene, is mixed into the dielectric ceramic powder at a predetermined ratio is prepared to make each of the dielectric layers 14*a*, . . . , 14*n* and the dielectric lens element 13, and these sheets are fuzed, resulting in a monolithic dielectric lens apparatus 11.

Figure 2:
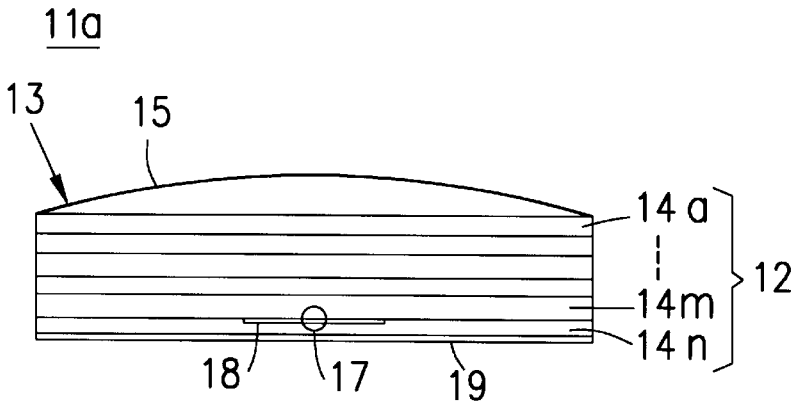
FIG. 2 is a sectional view illustrating a dielectric lens apparatus according to another embodiment of the present invention.
Figure 3:
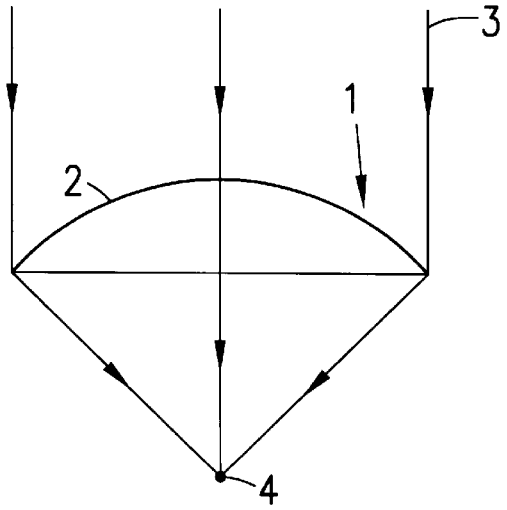
Fig. 3 PRIOR ART
FIG. 3 is a sectional view illustrating a conventional dielectric lens apparatus.

FIG. 2 is a sectional view illustrating a dielectric lens apparatus 11*a* according to another embodiment of the present invention. Since the dielectric lens apparatus 11*a* shown in FIG. 2 is provided with elements common to those of the dielectric lens apparatus 11 shown in FIG. 1, these common elements are given the same reference numerals and therefore, a description thereof is omitted.

In the dielectric lens apparatus 11*a* shown in FIG. 2, the focal point 17 is positioned at the interface between a dielectric layer 14*m* and a dielectric layer 14*n* which constitute the laminate element 12. An antenna 18, such as a patch antenna, which operates as a primary radiator is formed by patterning in the portion where the focal point 17 is positioned. Further, a grounding electrode 19 is formed on the outer surface of the laminate element 12 in such a manner as to face the antenna 18.

Since the antenna 18 is formed inside the laminate element 12 as described above, the dielectric lens apparatus 11*a* can be made to function as a dielectric lens antenna.

If a circuit is integrated into the dielectric lens apparatus by forming at least a part of a signal processing circuit, such as the above-described antenna 18, within and/or on the surface of the laminate element 12, the dielectric lens apparatus can be made multi-functional. Examples of signal processing circuits which can be integrated in the manner described above include, in addition to that described above, an amplification circuit, and a frequency conversion circuit. Further, such a circuit may be formed of a circuit pattern as in the antenna 18, or may be formed by adding discrete electronic parts on this circuit pattern. The positions at which these circuit elements are arranged can be selected as desired within or on the surface of the laminate element, and consideration is given not to hinder the propagation of radio waves in selecting the position of the arrangement.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation, so as to encompass all such modifications and equivalent structures and functions.

What is claimed is:

1. A dielectric lens apparatus, comprising:

a laminate element comprising a plurality of laminate dielectric layers having relative dielectric constants which are different for at least some adjacent layers; and a dielectric lens element which has a curved surface and which is bonded to a surface of said laminate element with said curved surface facing outwards;

wherein the laminate element and the lens element coact to form a focal point of said dielectric lens apparatus which is positioned within or at said surface of the laminate element.

2. A dielectric lens apparatus according to claim 1, further comprising a signal processing circuit at least part of which is within and/or on the surface of said laminate element.

3. A dielectric lens apparatus, comprising:

a laminate element comprising a plurality of laminated dielectric layers having relative dielectric constants which are different in at least some adjacent layers; and a dielectric lens element having a shape and being bonded to an outer surface of said laminate element;

said relative dielectric constants of said laminated dielectric layers and said shape of said dielectric lens element being selected to coact to provide a predetermined focal point;

wherein said focal point of said dielectric lens apparatus is positioned within or at said outer surface of the laminate element.

4. A dielectric lens apparatus according to claim 3, further comprising a signal processing circuit at least part of which is within and/or on the surface of said laminate element.

5. A dielectric lens apparatus according to claim 4, wherein said signal processing circuit part comprises an antenna.

6. A dielectric lens apparatus according to claim 5, wherein said antenna is within said laminate element and a ground conductor is formed on a surface of said laminate element so as to coact with said antenna.

7. A dielectric lens apparatus according to claim 3, wherein said shape of said dielectric lens element is convex and faces outwards.

8. A dielectric lens apparatus according to claim 3, wherein each said dielectric layer has the same thickness.

9. A dielectric lens apparatus according to claim 3, wherein the laminate element has a flat shape.

10. A dielectric lens apparatus according to claim 9, wherein each dielectric layer in the laminate element has a flat shape.

11. A dielectric lens apparatus according to claim 3, wherein each said dielectric layer is unitary and comprises a single layer having a predetermined dielectric constant.

12. A dielectric lens apparatus according to claim 3, wherein each adjacent pair of dielectric layers have different respective dielectric constants.

13. A dielectric lens apparatus according to claim 3, wherein said respective dielectric constants of said dielectric layers increase from layer to layer in a thickness direction throughout said laminate element.

14. A dielectric lens apparatus according to claim 3, wherein said respective dielectric constants of said dielectric layers increase from layer to layer in a thickness direction in part of said laminate element and decrease from layer to layer in said direction in another part of said laminate element.

15. A dielectric lens apparatus, comprising:

a laminate element comprising at least two laminated dielectric layers having relative dielectric constants, respectively; and a dielectric lens element having a shape and being coupled to an outer surface of said laminate element;

said relative dielectric constants of said laminated dielectric layers and said shape of said dielectric lens element being selected to coact to provide a predetermined focal point;

wherein said focal point is positioned within or at said outer surface of the laminate element.

16. A dielectric lens apparatus according to claim 15, further comprising a signal processing circuit at least part of which is within and/or on the surface of said laminate element.

17. A dielectric lens apparatus according to claim 16, wherein said signal processing circuit part comprises an antenna.

18. A dielectric lens apparatus according to claim 17, wherein said antenna is within said laminate element and a ground conductor is formed on a surface of said laminate element so as to coact with said antenna.

19. A dielectric lens apparatus according to claim 15, wherein said shape of said dielectric lens element is convex and faces outwards.

20. A dielectric lens apparatus according to claim 15, wherein each said dielectric layer has the same thickness.

21. A dielectric lens apparatus according to claim 15, wherein the laminate element has a flat shape.

22. A dielectric lens apparatus according to claim 21, wherein each dielectric layer in the laminate element has a flat shape.

23. A dielectric lens apparatus according to claim 15, wherein each said dielectric layer is unitary and comprises a single layer having a predetermined dielectric constant.

24. A dielectric lens apparatus according to claim 15, wherein each adjacent pair of dielectric layers have different respective dielectric constants.

25. A dielectric lens apparatus according to claim 15, wherein said respective dielectric constants of said dielectric layers increase from layer to layer in a thickness direction throughout said laminate element.

26. A dielectric lens apparatus according to claim 15, wherein said respective dielectric constants of said dielectric layers increase from layer to layer in a thickness direction in part of said laminate element and decrease from layer to layer in said direction in another part of said laminate element.

* * * * *